US006268834B1

(12) United States Patent
Josypenko

(10) Patent No.: US 6,268,834 B1
(45) Date of Patent: Jul. 31, 2001

(54) INDUCTIVELY SHORTED BICONE ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/575,541

(22) Filed: May 17, 2000

(51) Int. Cl.[7] ..... H01Q 13/04

(52) U.S. Cl. ..... 343/773; 343/727; 343/905

(58) Field of Search ..... 343/773, 774, 343/725, 727, 792, 807, 808, 878, 905; H01Q 9/28, 13/04

(56) References Cited

U.S. PATENT DOCUMENTS 5,534,880 * 7/1996 Button et al. ..... 343/774

* cited by examiner

*Primary Examiner*—Michael C. Wimer
(74) *Attorney, Agent, or Firm*—Michael J. McGowan; Robert W. Gauthier; Prithvi C. Lall

(57) ABSTRACT

A bicone antenna that facilitates the passage of cables for at least one other radiating antenna. The bicone antenna has a plurality of inductive shorts spaced approximately one-quarter wavelength (at the cut-in frequency) from the antenna axis. Each inductive short provides a pathway for a cable for another antenna. Consequently, an antenna cable from each of one or more other antennas can be led to a center point on the bicone antenna, directed radially along a cone to an inductive short, led through the inductive short and directed along the surface of the other cone to the center line. The outer conductor of each antenna cable attaches to an antenna surface.

17 Claims, 9 Drawing Sheets

(OPEN BICONE)

(SHORTED BICONE)

(OPEN BICONE)

(SHORTED BICONE)

INDUCTIVELY SHORTED BICONE ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to RF antennas and more specifically to a class of antennas known as bicone antennas.

(2) Description of the Prior Art

RF bicone antennas are well known in the art. For example, U.S. Letters Pat. No. 2,175,252 (1937) to Carter discloses a bicone antenna in which a high frequency apparatus drives two conical antenna elements. The high frequency apparatus drives the conical elements at their proximate apices. In this specific antenna, four insulating rods are equiangularly spaced about the periphery of the conical sections at the edges thereof to position the two cones.

U.S. Letters Pat. No. 2,218,741 (1939) to Buschbeck discloses another bicone antenna for operating over broad band. In this antenna a set of parallel resistances connect between a common point and a plurality of spared positions around the base of each cone. The parallel resistances have an aggregate value which is equal to the surge impedance of the antenna.

In U.S. Letters Pat. No. 4,074,268 (1978) to Olson, an antenna has the structure of a conic monopole above a ground plane. A plurality of vertical modulator fins constitute controllable shorting elements. The antenna also includes a plurality of suppressor posts that are used to shape the field radiating from the antenna.

U.S. Letters Pat. No. 5,134,420 (1992) to Rosen et al. discloses a bicone antenna with an orthomode tee as an input/output terminal, an internal dielectric polarizer, a circular waveguide with eight longitudinal radiating slots, two 30° conical reflectors, an external meanderline polarizer and a partial circular waveguide short. The partial circular waveguide short leaks a predetermined amount of radiation out of the end of the waveguide to fill the center hole of a doughnut-shaped radiation pattern to produce a hemispherical RF beam.

In U.S. Letters Pat. No. 5,367,312 (1994) to Masters, a biconical antenna is used to measure the intensity of incident RF electrical fields. This antenna comprises a pair of aligned rods with wires that define conical cavities around each of the rods. A ferrite choke surrounds each of the rods within the conical cavities to choke off resonances within the cavity.

Each of the foregoing references describes a different variation of a bicone antenna in the context of an antenna operating in isolation. That is, the antennas are not disclosed as being in proximity to other antennas. In a number of applications, however, antennas are often stacked, as on the mast of a ship. In such configurations, an antenna feed cable for one antenna must be routed past all antennas located below that one antenna. As will be evident, such cable routings are critical, because a misplaced cable can alter the radiation pattern of any antenna it passes.

For example, an IFF monocone now being used is a monocone fed monopole fed above a truncated ground plane in a stack of antennas. To allow a cable to pass this antenna, a quarter-wave shorted transmission line choke is placed on the axis of the monopole at its feedpoint to allow the cable to pass through the feed point of the antenna. The outer conductor of the transmission line connects to the monopole at its feedpoint; the center conductor of the transmission line, to the ground plane. The center conductor contains the cable to pass through the antenna. To allow the cable past the end of the monopole, the monopole is made hollow so that the inside of the monopole forms another $\lambda/4$ shorted transmission line. The first transmission line going up the monopole axis forms the center conductor and the inside of the monopole forms the outer conductor. Both are shorted near the feed point. Consequently an infinite impedance exists between the end of the monopole and the feed through cable at a quarter wavelength.

This approach imposes certain restrictions. For example, the chokes that mount on the antenna axis have a finite high impedance bandwidth. This bandwidth limits the choking action and the bandwidth where the impedance of the chokes does not change the matched impedance of the antenna thereby changing the bandwidth of the antenna.

Placing a quarter wave shorted transmission line choke on the antenna axis also requires feeding the antenna off axis. Consequently the feedpoint of the monopole becomes the lower end of the outer conductor of the axial choke transmission line. This produces asymmetrical azimuth patterns at higher frequencies.

It has also been found that the impedance bandwidth characteristics for such a monocone are reduced significantly. It becomes questionable as to whether the antenna with the chokes can be broadband matched. In one specific antenna, for example, the bandwidth for a VSWR of 2:1 is about 11%. For a VSWR of 3:1 it is about 28%. Both are considerably less than the bandwidth characteristics for a monopole without such chokes. With bicone antennas, it is possible to obtain infinite bandwidths above a certain "cut-in" frequency, i.e., the frequency at and above which the VSWR becomes a low, flat VSWR about an antenna $Z_o$ value.

The use of shorting elements in antennas is also known. For example, bifilar and quadrifilar helix antennas often contain a wire or plate of low inductive impedance that is close to being a short circuit across the end of the helix. These shorts rotate the reflection coefficient by approximately 180° without any significant change in the VSWR (relative to the antenna $Z_o$) above the antenna cut-in frequency. Moreover, patterns emanating from the antenna remain approximately the same although there may be some increase in back side radiation. The primary purpose of using such elements is to allow a coaxial feed cable to be introduced onto the antenna at a zero RF point and to then use the antenna as an infinite balun to allow the cable to be brought to and connected to the antenna's feed point. In other antennas, a cylindrical slot can be shorted at both of its ends at least a quarter of a wavelength from its center where likewise a feed cable can be introduced onto the antenna structure at one of the shorts. An endfire slot normally extends on the non-radiating side of its feed point for less than a quarter of a wavelength and is then shorted so that a coaxial feed cable can also be introduced onto the antenna to feed the antenna.

Similar elements are used in both dipole or slot antennas. An early submarine antenna, known as an AS-1288/BPXIFF antenna, comprises a monocone above a ground plane. This antenna includes nearly ideal short circuits at its ends between the top and the ground plane to physically support the cone. Partial radial short circuits exist above these shorts and probably provide a small amount of isolation between the shorts to ground and the monocone. Likewise, the part of the monocone below the radial short circuit tapers from the inside diameter of the radial short, which can provide some isolation to ground. The small opening of this antenna at the shorts and the close to zero impedance of the shorts probably raise the cut-in frequency of the unshorted antenna appreciably and make the antenna have a limited impedance bandwidth.

SUMMARY OF THE INVENTION

Therefore it is an object of this invention to provide a bicone antenna that facilitates the passage of cables past the antenna to other antennas.

Another object of this invention is to provide a bicone antenna that facilitates the passage of cables past the antenna to other antennas while maintaining almost the same broad impedance match of an open bicone antenna.

Still another object of this invention to provide a bicone antenna that facilitates the passage of cables past the antenna to other antennas whereby the antenna maintains the symmetrical patterns of an open bicone antenna in the azimuth plane.

In accordance with one aspect of this invention, a bicone antenna is adapted for enabling a cable for an other antenna to pass the bicone antenna. The bicone antenna comprises first and second oppositely directed cones energized at their respective apices and opening along an antenna axis and a plurality of conductive members parallel to the antenna axis and angularly spaced at the peripheries of the bicones. Each conductive member can be designated to receive an antenna cable to form a pathway for the cable. Consequently each feed cable for another antenna passes the bicone antenna through a designated conductive member at the peripheries of the cones without affecting the characteristics of the bicone antenna. In accordance with another aspect of this invention a bicone antenna is adapted for enabling one or more cables for one or more other antennas to pass the bicone antenna. The bicone antenna comprises first and second oppositely directed cones energized at their respective apices and opening along an antenna axis, the cones operating at frequencies above a characteristic cut-in frequency and at least three near ideal shorting members parallel to the antenna axis. The shorting members are radially spaced from the apices by approximately one-quarter wavelength at the cut-in frequency thereby appearing normally at a high impedance at the apices feed point at the cut-in frequency. Each shorting member designated to receive a cable is formed as a channel to support a cable between the outer peripheries of the cones without affecting the characteristics of the bicone antenna.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
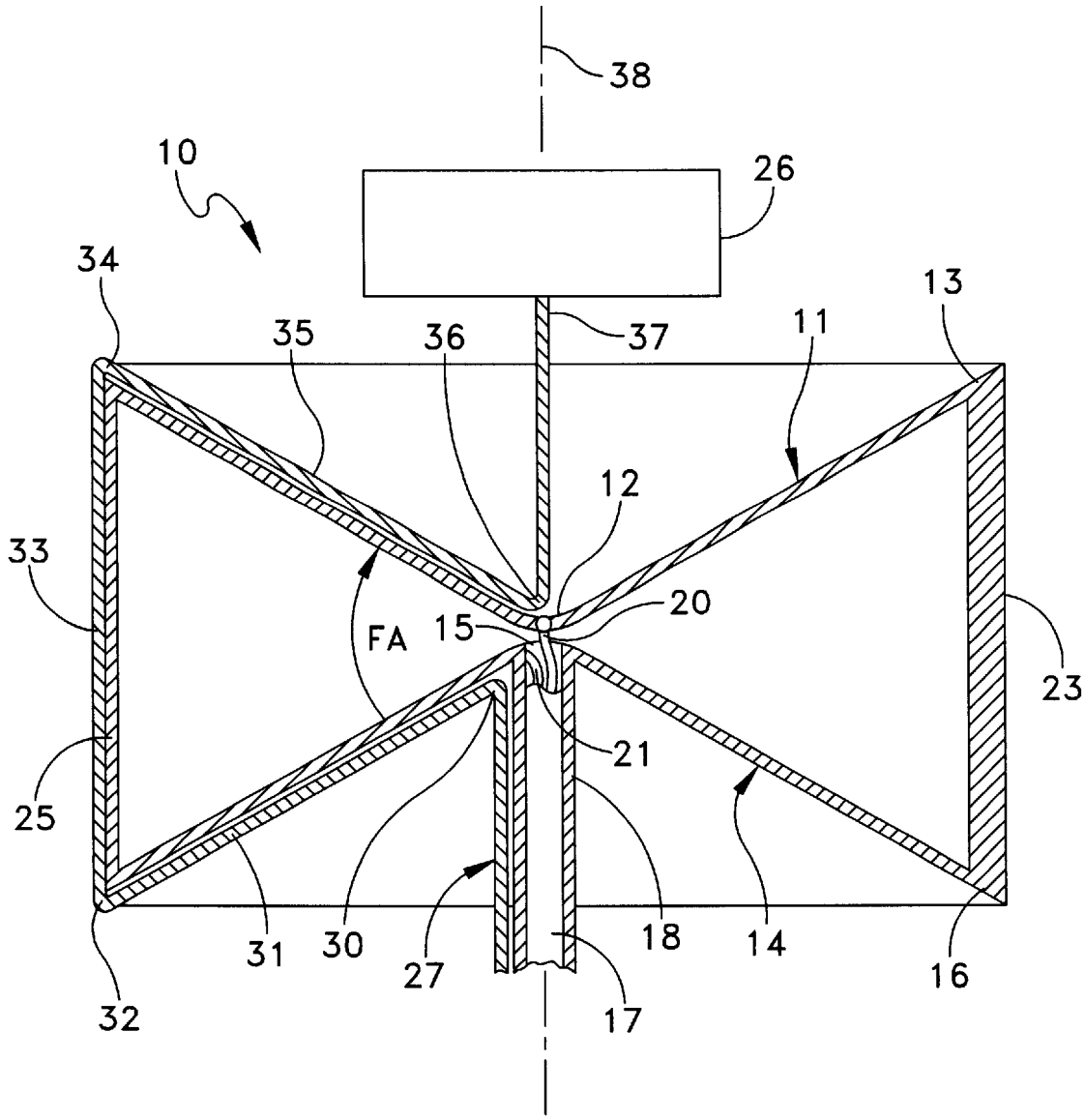
FIG. 1 is a view in cross-section of a bicone antenna constructed in accordance with this invention.
Figure 2:
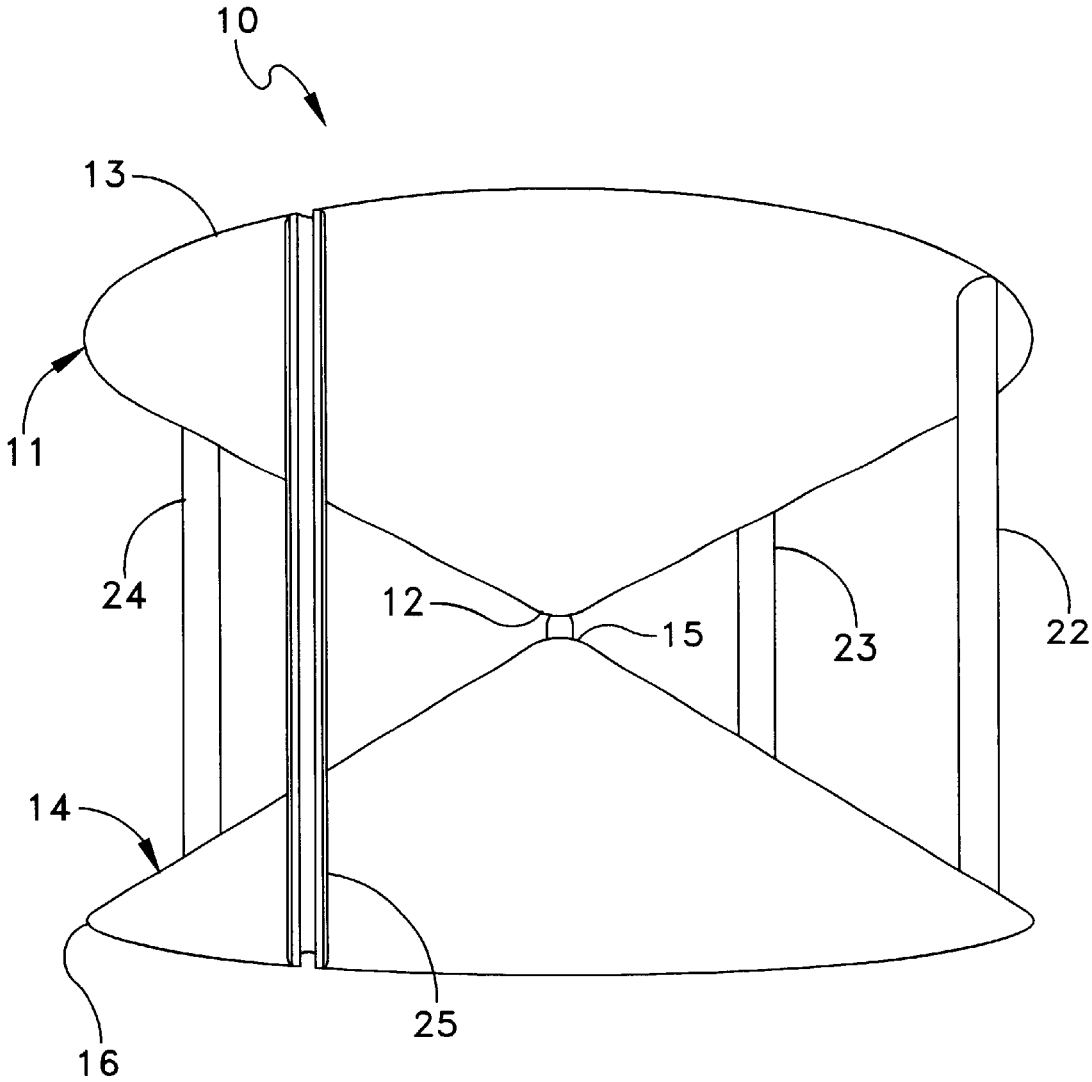
FIG. 2 is a side view of the antenna shown in FIG. 1.
Figure 3:
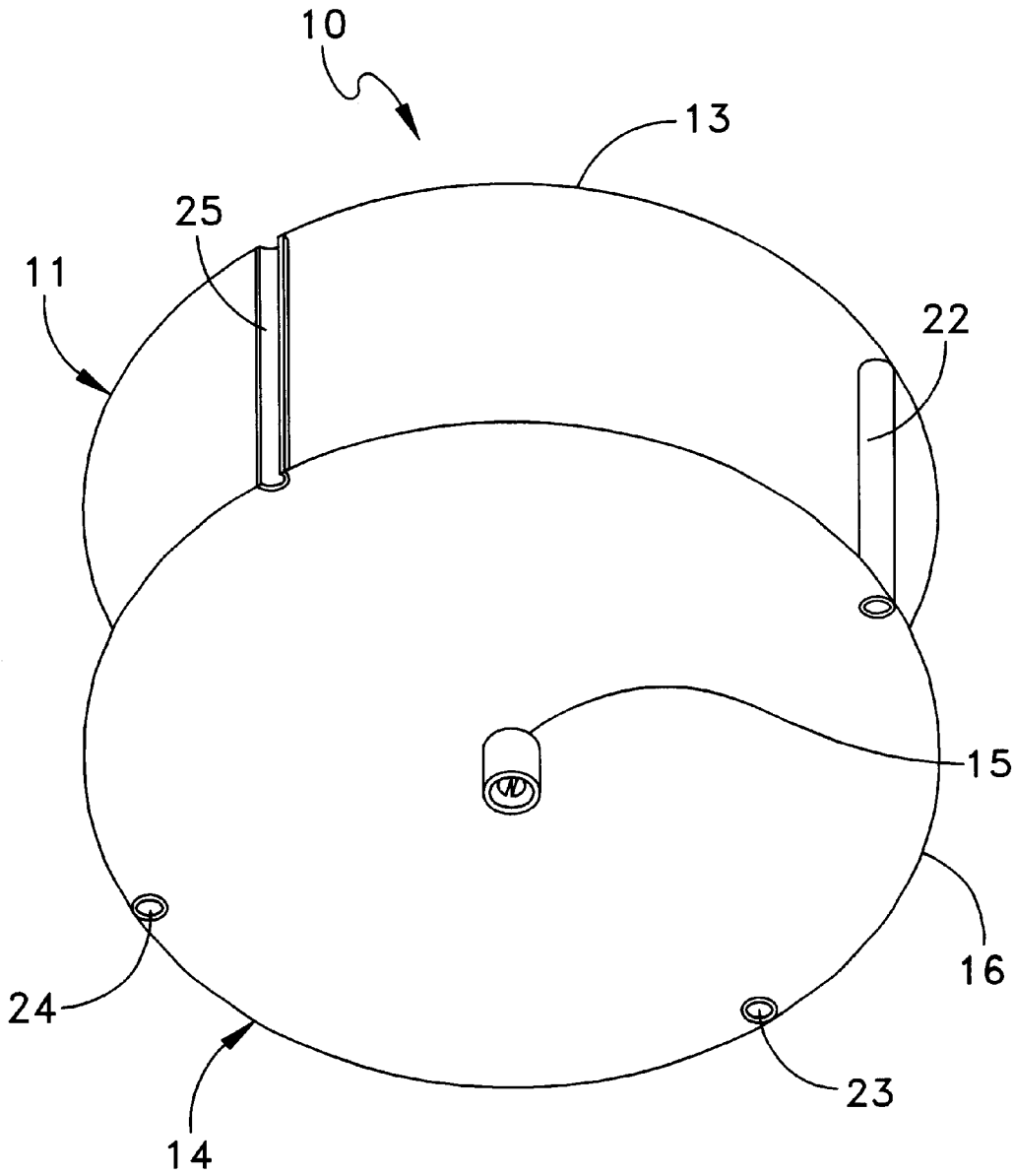
FIG. 3 is a bottom view of the antenna shown in FIG. 1.

FIGS. 1 through 3 depict a bicone antenna 10 with a top cone 11 expanding from an apex 12 to an annular end 13 and a bottom cone 14 expanding from the apex 15 to an annular end 16. FIG. 1 depicts a method by which such a bicone antenna 10 is fed through a coaxial cable 17 extending through an optional tube or other protective sheath 18 to the apices 12 and 15. In this particular configuration a center conductor 20 of the coaxial cable 17 attaches to the upper cone 11 at the apex 12; an outer conductor 21 attaches to the bottom cone 14 at its apex 15.

As most clearly shown in FIGS. 2 and 3, the bicone antenna 10 includes a plurality of conductive inductive shorts 22 through 25 that extend between and are attached to the annular ends 13 and 16 of the bicone antenna 10. Four such inductive shorts are shown. Three or more inductive shorts could be utilized. As will also be apparent the conductive shorts also can be used to support the upper top cone 11 and bottom cone 14 with respect to each other. In the particular embodiment shown in FIGS. 2 and 3, each of the inductive shorts is formed as a tube. As an alternative, semi-rigid coaxial cable could replace any of the tubes 22 through 25.

Referring again to FIG. 1, the bicone antenna 10 lies between various RF sources to the bottom of FIG. 1 (not shown) and another antenna 26 above the bicone antenna 10. For each antenna 26, one inductive short, such as the inductive short 25, is modified to accommodate a cable 27 for feeding the antenna 26. For example, if the inductive short 25 comprises a tube, the tube may be cut in half as particularly shown in FIG. 2. If the conductive element is a solid rod it might be replaced with a semi-cylindrical channel portion. As still another alternative, where semi-rigid coaxial cables form the inductive shorts 22 through 25, the coaxial cable forming the inductive short 25 could be formed by cutting the coaxial cable in half and removing the cable center conductor and dielectric to form a channel. In whatever form, there is one such channel for each antenna to be fed.

Referring to FIG. 1, the antenna 26 then can be fed by directing its cable 27 parallel to the tubular sheath 18 or mast to a position adjacent the apex 15. The cable 27 forms a bend 30 and a segment 31 extending along the base of the bottom cone 14 to the entrance of a channel formed by the inductive short 25. Another bend 32 in the cable enables the cable to be directed as a segment 33 lying in the channel. At a bend 34 the cable 27 is directed back toward the apex 12 along a segment 35. Finally, the cable is directed from a bend 26 at the apex 12 as a vertical segment 37 to the antenna 26 along the antenna axis 38. From a mechanical standpoint, this provides a path for the cable 27 that does not increase any mechanical load on the antenna 10. Electrically, the antenna 10 does not "see" the cable 27 as: an outer conductor of cable 27 (not shown) connects to the metal surfaces of antenna 10; the antenna axis 38 and mast 18 are a null point in the antenna; the cable segments 31 and 35 are shielded from the radiating inside of antenna 10; and the segment 33 follows the existing short 25 across the radiating aperture of the antenna 10.

Electrically, it has been found that the bicone antenna 10 has at least the same bandwidth as a prior art monopole antenna located above a truncated ground plane above a cut-in frequency. In one particular embodiment, the diameters of the bicones 11 and 14 were maximized to be slightly less than the inside diameter of a protective radome. This lowered the cut-in frequency. A further reduction in the cut-in frequency was obtained by making the antenna 10 taller so the feed angle was somewhat larger than that which makes the antenna 10 characteristic impedance 50 ohms. Consequently, although the cut-in frequency is reduced, some impedance mismatches can occur. As previously indicated, the feed to bicone antenna 10 extended along mast 18, or antenna axis 38, as particularly shown in FIG. 1.

The concept of placing an impedance close to a short, such as the inductive short 25 across an antenna, at least approximately one-quarter wavelength away from the antenna at the apices 12 and 15, allows cables to brought across the antenna. Near cut-in, the inductive short 25 and the sides of cones 11, 14 adjacent segments 35, 31 can be considered as a radiating quarter wave shorted transmission line choke placed across the antenna feed as opposed to a non-radiating quarter wave shorted transmission line choke that was placed across the antenna feed of the monopole. As a result a less severe loss of matched bandwidth occurs. More specifically, in some prior art shorted antennas, the shorts are at least one-quarter wavelength away from the feedpoint and thus appear as an open circuit at the quarter-wave frequency at the feed. At higher frequencies, even though they will appear as a short at multiple half waves from the feedpoint, there is a radiation loss associated with this impedance, since the antenna 10 is at least $\lambda/2$ (one half wavelengths long before it sees the short and is thus given a chance to radiate before the short. Thus above the cut-in frequency of the open bicone, the shorts simply rotate the reflection coefficient of the open bicone roughly 180°. Typically at the cut-in frequency the inductive shorts 22 through 25 are somewhat less than a quarter wave away from the feedpoint. Consequently, it can be considered that the cut-in frequency of the open bicone and the cut out frequency of the shorts are roughly the same. Stated alternatively, the shorts truly short out the antenna below the cut-in frequency.

The parameters of the inductive shorts in accordance with this invention are important. They should be at the extreme annular ends of the cone such as the annular ends 13 and 16. If they are brought closer to the feedpoint, the cut-in frequency of the antenna rises to a value slightly lower than the value obtained if the cones were to be truncated at new locations where the shorts connect to the bicone. Stated alternatively, very little reduction of the cut-in frequency is obtained by extending the cones beyond the points where the shorts connect to the cones; that is approximately one-quarter wavelength from the axis 38.

As the number of inductive shorts increases, the cut-in frequency increases. At an extreme, when the shorts become a continuous cylinder, the antenna can not radiate. Thus the number of conductive shorts and thickness of the shorts should be minimized. However, with one or two shorts, antenna patterns may be asymmetric in the azimuthal plane.

For symmetrical azimuthal patterns, at least three shorts are needed. As the frequency rises, nulls form about the inductive shorts and continue in depth with frequency. This imposes a minimum distance that can separate the shorts for reasonable azimuthal patterns. Although this might indicate additional shorts should be added at higher frequencies, the net effect of such a modification would raise the cut-in frequency; this is not desirable.

An antenna has been constructed in accordance with this invention. It has a diameter across the ends 13 and 16 of 4.75 inches. Each cone has an altitude of 1.37 inches. The slope of the cones was selected at 30° from a horizontal thereby to provide a 60° feed angle (FA) as shown in FIG. 1. The measured characteristic impedance of the antenna at the apices 12 and 15 was 60 ohms before applying the inductive shorts 22 through 25. This was reduced to 50 ohms when the inductive shorts 23 through 25 were added. Each of these shorts was constituted by tubing with an outer diameter of 0.141".

Figure 4A:
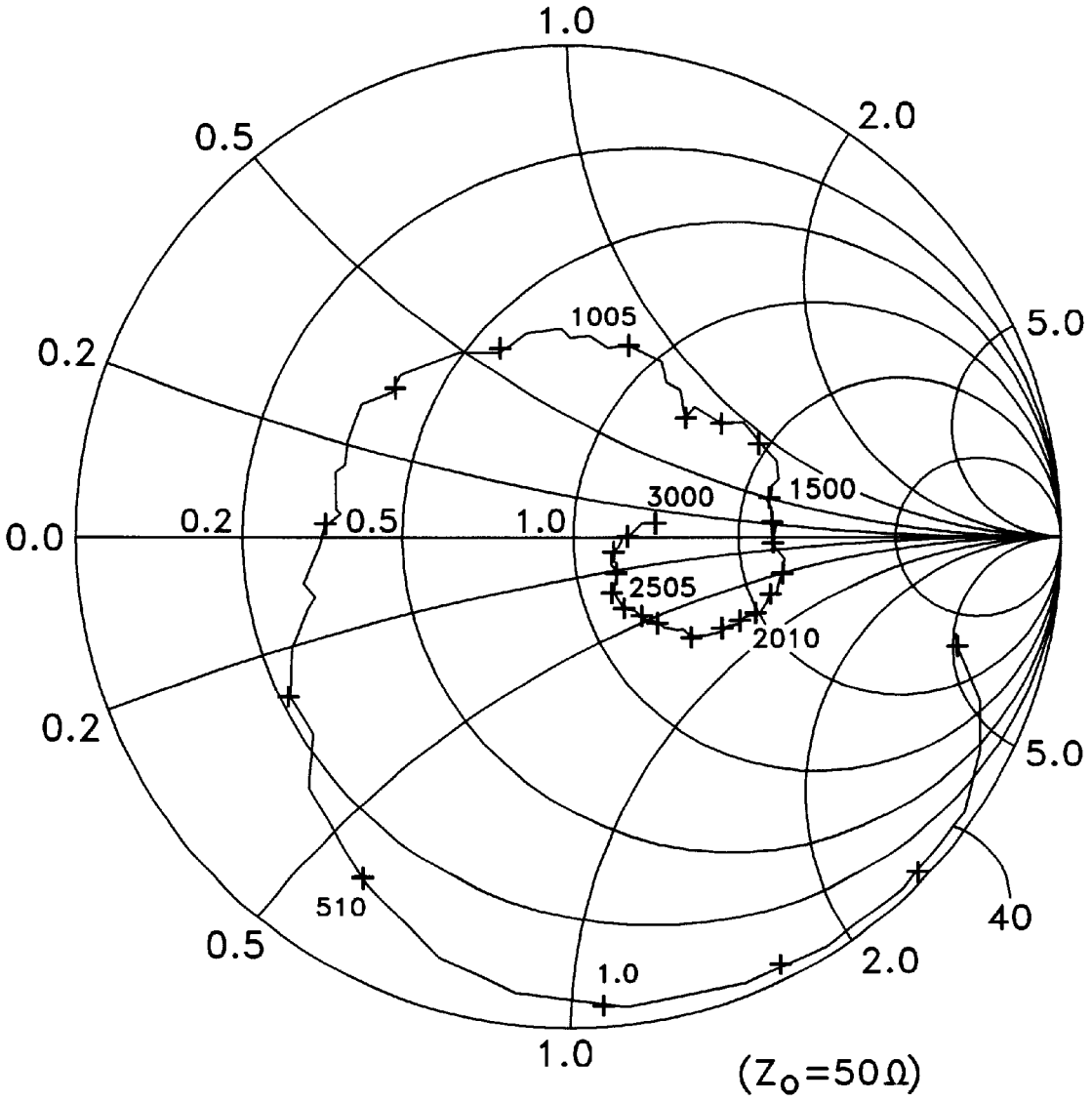
FIGS. 4A and 4B compare the impedance of the antennas shown in FIG. 1 with a conventional bicone antenna.
Figure 4B:
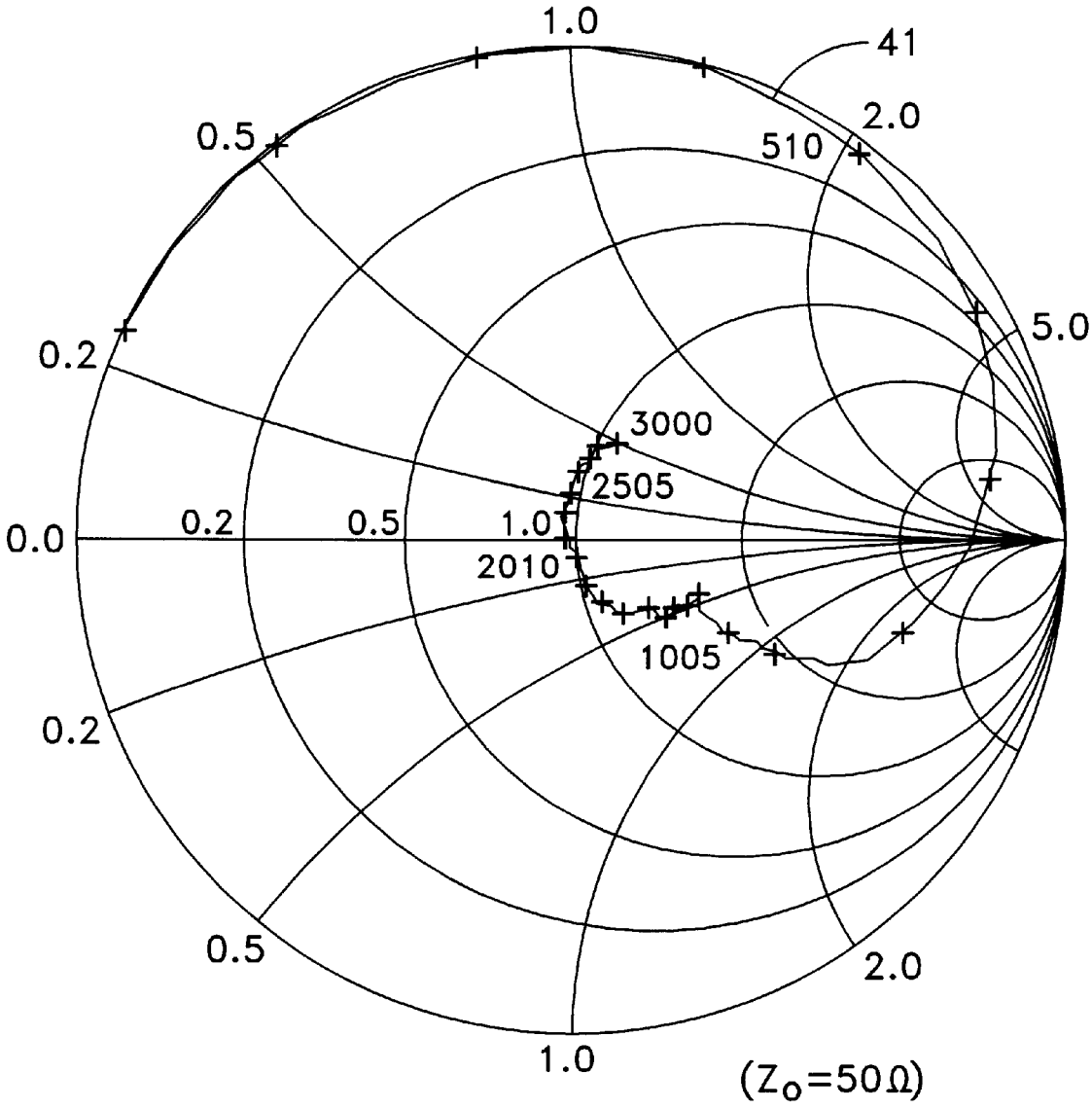

FIGS. 4A and 4B depict two Smith charts. The first, (FIG. 4A, graph 40) represents the impedance of a bicone antenna similar to antenna 10 of FIGS. 1 through 3, but without any of the inductive shorts 22 through 25, at a characteristic impedance of 60 ohms. Graph 41 of FIG. 4B depicts the impedance with the inductive shorts added for an impedance of 50 ohms. As previously indicated, FIG. 4B depicts an approximately 180° shift in the impedance locus at lower frequencies.

Specifically, graph 41 indicates an anti-resonance loop near 1300 MHz. Typically this results from the effect of two different impedances (the bicone impedance and the impedance of the shorts), such as two adjacent resonances whose impedances are combined in parallel. The net effect is the loops formed by the graphs 40 and 41 tighten the impedance locus in the area of the loops resulting in some gain in impedance bandwidth in this area.

Figure 5A:
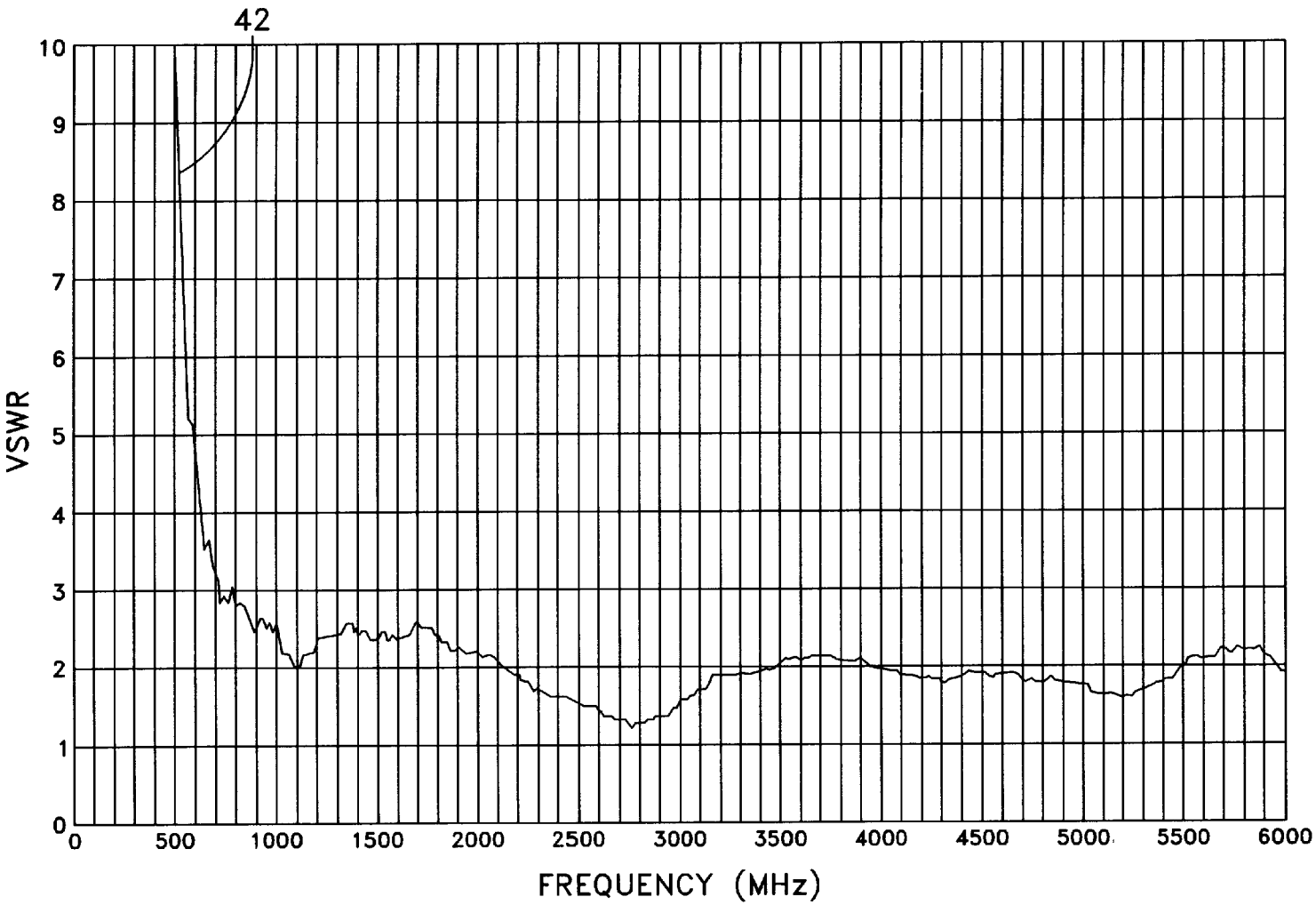
FIGS. 5A and 5B compare the VSWR of the bicone in FIG. 1 with respect to a standard bicone antenna.
Figure 5B:
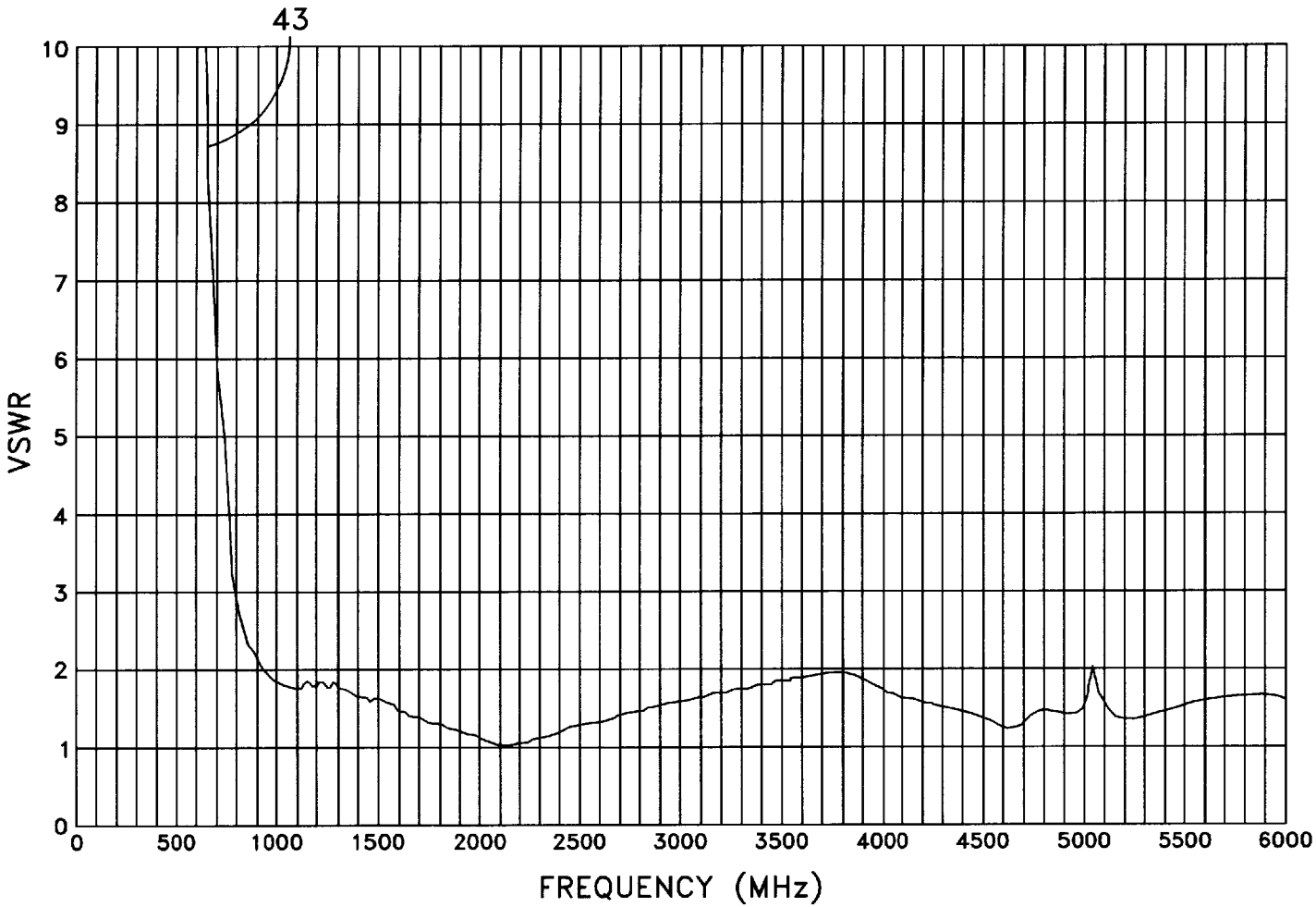
Figure 6B:
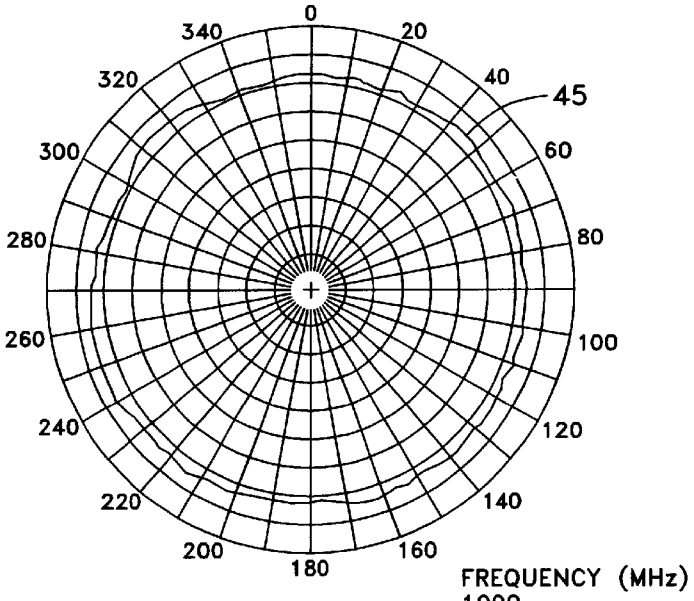
FIGS. 6A through 6F depict the radiation patterns at different frequencies from a bicone antenna as disclosed in FIG.
Figure 6A:
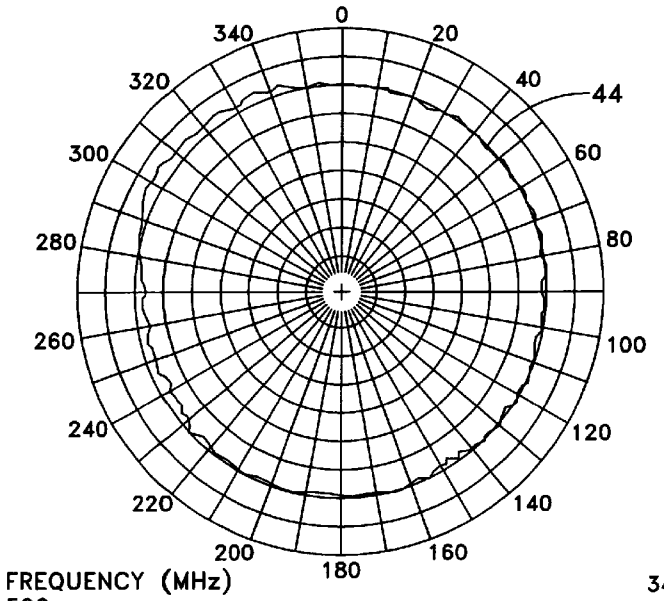
Figure 6C:
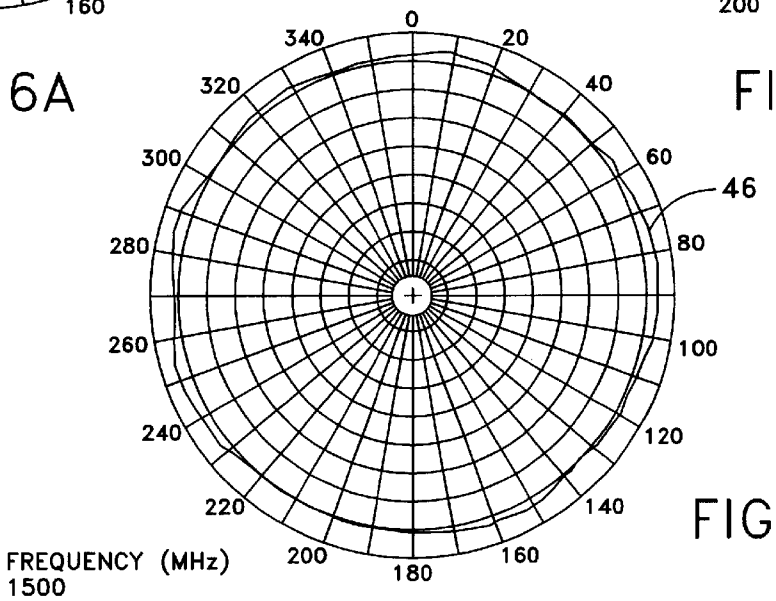
Figure 6D:
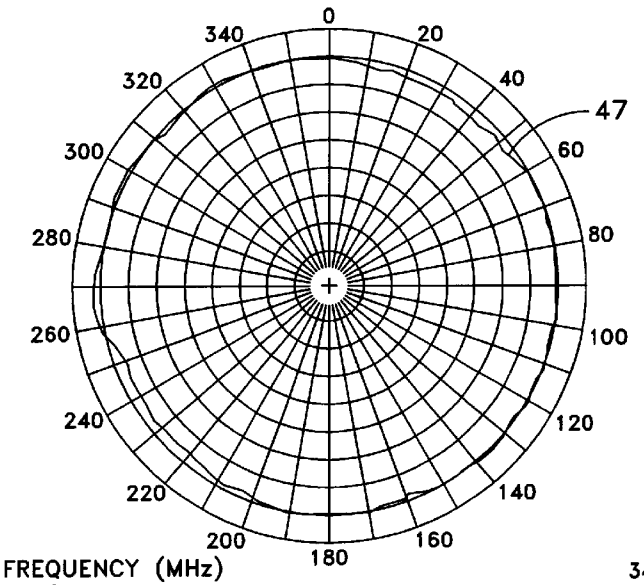
Figure 6E:
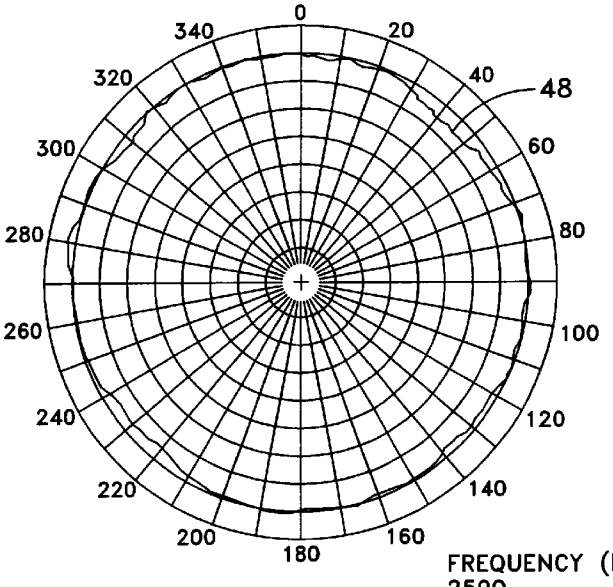
Figure 6F:
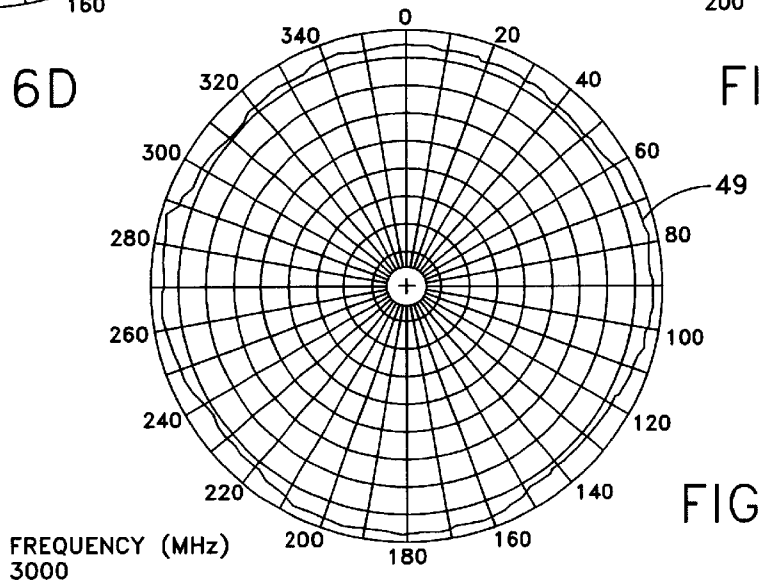

FIGS. 5A and 5B use graphs 42 and 43 to compare the VSWR of an antenna 10 without the inductive shorts and with the inductive shorts, respectively. A comparison of graphs 42 and 43 depicts that the VSWR bandwidth is greater than 600%, a sizable improvement over the narrow monopole antenna. The cut-in frequency of the shorted bicone is somewhat higher than the open bicone. This characteristic depends upon the number of shorts, the finite width of the conductive shorts and reduction of the effective cone radius produced by the placement of and diameter of the inductive shorts.

FIGS. 6A through 6F depict the antenna patterns over a range of 500 MHz to 3,000 MHz. Specifically the graphs 44 through 49, that are shown in FIGS. 6A through 6F respectively, indicate an essentially symmetrical pattern. Some asymmetry exists at 500 MHz, since the antenna is below cut-in and thus currents may flow down the bicone backside and down the cables, at least near the open areas of the antenna. As the frequency increases, particularly above 1500 MHz, small nulls are observed. These are coincident with the position of the inductive shorts 22 through 25. Measurements indicate that the nulls will become deeper if the separation between the inductive shorts becomes an appreciable part of a wavelength.

Viewing these results it will be apparent that the antenna shown in FIGS. 1 through 3 meets the several objectives of this invention. The bicone antenna facilitates the passage of cables from one antenna to other antennas. This occurs while maintaining almost the same broad impedance match of an open bicone antenna and while continuing to provide a symmetrical radiation pattern in the azimuth plane.

A number of alternatives for constructing such an antenna have been disclosed. Still other alternatives exist. For example, each of the inductive shorts could also be formed by increasing the length of the inductive shorts, as by using a coiled coaxial cable. Such an increase in the inductance is expected to prevent any increase in the cut-in frequency over that of an open bicone having the same general form. As will also be apparent, once each of the conductive shorts 20 through 25 establishes a pathway across the bicone antenna 10, it is a simple matter to bring cables across that antenna. As particularly shown in FIG. 1, the cables approach the bicone along the mast 18 (antenna axis 38) and follow the outside of the cones to minimize any coupling to the feed side of the cones and thus maintain azimuth pattern symmetry and then cross to the feed side of the cones via shorts after which they again follow the outside of the cones to minimize any coupling.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A bicone antenna adapted for enabling a cable for an other antenna to pass said bicone antenna comprising:

first and second oppositely directed conductive cones energized at their respective apices and opening along an antenna axis; and a plurality of conductive members parallel to the antenna axis and angularly spaced at the peripheries of the bicones, at least one of the conductive members forming a pathway whereby the cable for the other antenna passes the bicone antenna through said pathway without affecting the characteristics of said bicone antenna.

2. An antenna as recited in claim 1 wherein said plurality of conductive members is at least three.

3. An antenna as recited in claim 2 wherein said plurality of conductive members are equiangularly spaced about the peripheries of said bicones.

4. An antenna as recited in claim 1 wherein said plurality of conductive members are equiangularly spaced.

5. A bicone antenna as recited in claim 1 wherein the antenna cable contains an outer conductor, the outer conductor of the cable being connected to a conductive surface of the antenna.

6. A bicone antenna adapted for enabling a cable for an other antenna to pass said bicone antenna comprising:

first and second oppositely directed conductive cones energized at their respective apices and opening along an antenna axis, said cones operating at frequencies above a characteristic cut-in frequency; and at least three shorting members parallel to the antenna axis and radially spaced therefrom by approximately one-quarter wavelength at the cut-in frequency thereby to act normally at a high impedance at the cut-in frequency, at least one of said shorting members being adapted to support the cable between the peripheries of said cones whereby the cable can pass the bicone antenna without affecting the characteristics of said bicone antenna.

7. A bicone antenna as recited in claim 6 wherein each shorting member adapted to receive an antenna cable includes an elongated channel for positioning the cable.

8. A bicone antenna as recited in claim 7 wherein the antenna cable contains an outer conductor, the outer conductor of the cable being connected to a conductive surface of the antenna.

9. A bicone antenna as recited in claim 7 wherein said shorting members are tubular and each shorting member adapted to receive an antenna cable includes an elongated channel formed by removing a portion of the tubular member.

10. A bicone antenna as recited in claim 9 wherein the antenna cable contains an outer conductor, the outer conductor of the cable being connected to a conductive surface of the antenna.

11. A bicone antenna as recited in claim 6 wherein said shorting members are rigid cylindrical structures and each shorting member adapted to receive an antenna cable includes an elongated channel formed by removing a portion of the rigid cylindrical structure.

12. A bicone antenna as recited in claim 11 wherein the antenna cable contains an outer conductor, the outer conductor of the cable being connected to a conductive surface of the antenna.

13. A bicone antenna as recited in claim 6 wherein said at least three shorting members total a number of four.

14. A bicone antenna as recited in claim 6 wherein the antenna cable contains an outer conductor, the outer conductor of the cable being connected to a conductive surface of the antenna.

15. A bicone antenna adapted for enabling at least one other antenna cable to pass said bicone antenna comprising:

first and second oppositely directed conductive cones energized at their respective apices and opening along an antenna axis; and at least one conductive member parallel to the antenna axis, each conductive member forming a pathway whereby one of the other antenna cables passes the bicone antenna through said pathway without affecting the characteristics of said bicone antenna.

16. An antenna as recited in claim 15 wherein the conductive members are equiangularly spaced about the peripheries of the cones when the conductive members number more than one.

17. An antenna as recited in claim 15 wherein the at least one conductive member is radially spaced from the antenna axis by approximately one-quarter wavelength at a characteristic cut-in frequency above which the bicone antenna operates.

* * * * *